US005827476A

United States Patent [19]

Lindén et al.

[11] Patent Number: 5,827,476

[45] Date of Patent: Oct. 27, 1998

[54] AUSTENITIC STAINLESS STEEL WITH GOOD OXIDATION RESISTANCE

[75] Inventors: Johan Lindén, Gävle; Jonas Rosén, Sandviken, both of Sweden

[73] Assignee: Sandvik AB, Sandviken, Sweden

[21] Appl. No.: 805,339

[22] Filed: Feb. 24, 1997

[30] Foreign Application Priority Data

Feb. 26, 1996 [SE] Sweden ..... 9600709

[51] Int. Cl.[6] ..... C22C 38/50; C22C 38/48

[52] U.S. Cl. ..... 420/40; 420/53; 420/54

[58] Field of Search ..... 420/40, 53, 54

[56] References Cited

U.S. PATENT DOCUMENTS 4,141,762 2/1979 Yamaguchi et al. ..... 420/53

5,489,416 2/1996 Takahashi et al. ..... 420/40

FOREIGN PATENT DOCUMENTS 61-23749 2/1986 Japan ..... 420/40

*Primary Examiner*—Deborah Yee

*Attorney, Agent, or Firm*—Burns, Doane, Swecker & Mathis, L.L.P.

[57] ABSTRACT

A new austenitic stainless steel comprising in % by weight:

C: <0.12,

Si: <1.0,

Cr: 16–22,

Mn: <2.0,

Ni: 8–14,

Mo: <1.0, either Ti: >4% by weight of C and <0.8 or Nb: 8% by weight of C and <1.0,

S: <0.03,

O: <0.03,

N: <0.05,

REM: ≦0.30 and >0.10, and the remainder Fe and normally occurring impurities, REM being one or more of the elements Ce, La, Pr and Nd. The new steel is particularly suitable as a superheater steel and a heat exchanger steel.

9 Claims, 6 Drawing Sheets

AUSTENITIC STAINLESS STEEL WITH GOOD OXIDATION RESISTANCE

BACKGROUND OF THE INVENTION

The present invention relates to an austenitic stainless steel with a particularly good oxidation resistance for use in applications as a superheater steel, such as for instance in conventional carbon boilers.

High demands for good oxidation and corrosion resistance, strength at increased temperatures and structural stability, are made on materials which are used in high temperature applications. Structural stability implies that the structure of the material during operation shall not degenerate into fragility-causing phases. The choice of material depends on the temperature, the load, and of course, on the cost.

By oxidation resistance, which is of considerable importance for the steel of the present invention, is in high temperature contexts meant the resistance of the material against oxidation in the environment to which it is subjected. Under oxidation conditions, i.e., in an atmosphere that contains oxidizing gases (primarily oxygen and water vapor), an oxide layer is formed on the steel surface. When the oxide layer attains a certain thickness, oxide flakes detach from the surface, a phenomenon called scaling. With scaling, a new metal surface is exposed, which also oxidizes. Thus, by the fact that the steel is continuously transformed into its oxide, its load-carrying capability will gradually deteriorate.

The scaling may also result in other problems. In superheater tubes, the oxide flakes are transported away by the vapor and if accumulations of these flakes are formed in, e.g., tube bends, the vapor flow in the tubes may be blocked and cause a break-down because of overheating. Further, the oxide flakes may cause so called solid particle erosion in the turbine system. Scaling may also cause great problems in a boiler, which manifest themselves in the form of a lower efficiency, unforeseen shutdowns for repairs and high repairing costs. Smaller scaling problems render it possible to run the boiler with a higher vapor temperature, which brings about an increased power economy.

Thus, a material with good oxidation resistance should have the capability to form an oxide that grows slowly and that has a good adhesion to the metal surface. The higher the temperature that the material is subjected to, the stronger is the oxide formation. A measure of the oxidation resistance of the material is the so called scaling temperature, which is defined as the temperature at which the oxidation-related loss of material amounts to a certain value, for instance, 1.5 $g/m^2h$.

A conventional way to improve the oxidation resistance is to add chromium, which contributes by giving to the material a protective oxide layer. At increased temperature, the material is submitted to deformation by creep. An austenitic basic mass, which is obtained by addition of an austenite stabilizing substance such as nickel, influences favorably the creep strength, as does precipitations of a minute secondary phase, for instance carbides. The alloying of chromium into steel brings about an increased tendency to separate the so-called sigma phase, which may be counteracted by, as indicated above, the addition of austenite stabilizing nickel.

Both manganese and nickel have a positive influence on the structure stability of the material. Both these elements function as austenite-stabilizing elements, i.e., they counteract the separation of fragility-causing sigma phase during operation. Manganese also improves the heat check resistance during welding, by binding sulphur. Good weldability constitutes an important property for the material.

Austenitic stainless steels of the type 18Cr-10Ni have a favorable combination of these properties and are therefore often used for high temperature applications. A frequently occurring alloy of this type is SS2337 (AISI Type 321), corresponding to Sandvik 8R30. The alloy, which may have a commercial analysis comprising in weight % as follows:

C: 0.04–0.08

Si: 0.3–0.7

Mn: 1.3–1.7

P: max 0.040

S: max 0.015

Cr: 17.0–17.8

Ni: 10.0–11.1

Mo: max 0.7

Ti: max 0.6

Cu: max 0.6

Nb: max 0.05

N: max 0.050 has a good strength, thanks to the addition of titanium, and a good corrosion resistance, so it has for many years been used in, e.g., tubes for superheaters in power plants. However, the weakness of this alloy is that the oxidation resistance is limited, which brings about limitations with regard to operable life and maximum temperature of use.

The Soviet inventor's certificate SU 1 038 377 discloses a steel alloy which is said to be resistant to stress corrosion, primarily in a chlorine-containing environment. However, this type of problem concerns substantially lower temperatures than superheater applications. It contains (in % by weight) 0.03–0.08 C, 0.3–0.8 Si, 0.5–1.0 Mn, 17–19 Cr, 9–11 Ni, 0.35–0.6 Mo, 0.4–0.7 Ti, 0.008–0.02 N, 0.01–0.1 Ce and the remaining Fe. Moreover, its heat check resistance and weldability are unsatisfactory.

OBJECTS AND SUMMARY OF THE INVENTION

It is an object of this invention to avoid or alleviate the problems of the prior art.

Thus, a primary object of the present invention is to provide a steel that has a very good oxidation resistance, and thereby an extended life, at high temperature applications, primarily in a vapor environment.

A second object of the present invention is to provide a steel that has an increased maximum temperature of use.

These and further objects have been attained in a surprising way by providing an austenitic stainless steel comprising, in % by weight:

C: <0.12,

Si: <1.0,

Cr: 16–22,

Mn: <2.0,

Ni: 8–14,

Mo: <1.0, either Ti: >4% by weight of C and <0.8 or Nb: 8% by weight of C and <1.0,

S: <0.03,

O: <0.03,

N: <0.05,

REM: ≦0.30 and >0.10, and the remainder Fe and normally occurring impurities, REM being one or more of the elements Ce, La, Pr and Nd.

This steel may be used as a superheater steel or a heat exchanger steel, particularly in the convection part of an ethene oven.

DETAILED DESCRIPTION OF THE PREFERRED EMBODIMENTS OF THE INVENTION

Figure 1:
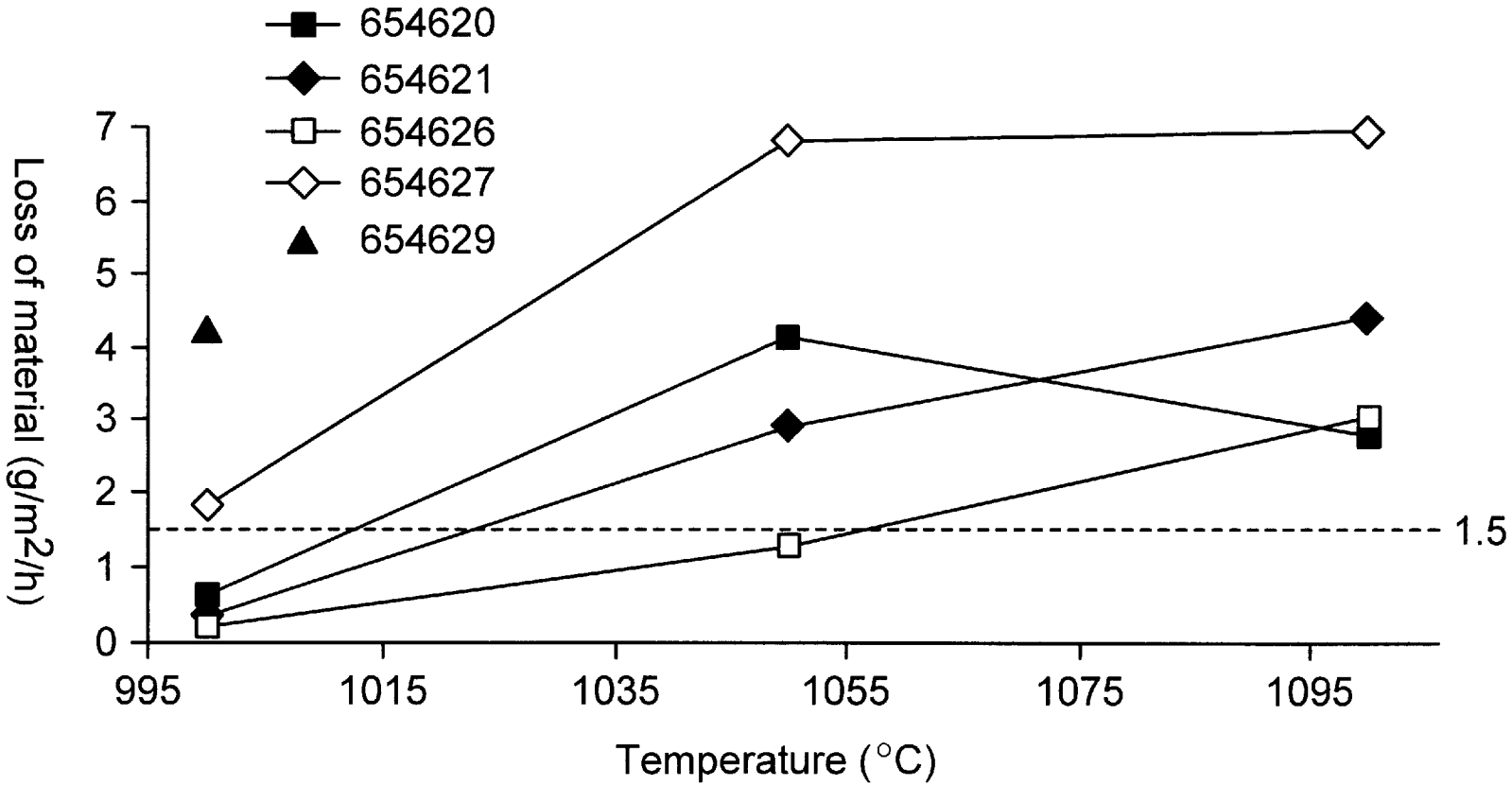
FIG. 1 is a graph of scaling temperature vs. loss of material for various compositions.

In principle, the present invention consists of a modified and improved variant of SS2337. The essential feature of the present invention is that one adds the rare earth metals cerium, lanthanum, neodymium and/or praseodymium to an alloy which substantially corresponds to SS2337, however with the exception that the ranges for some of the elements are widened. In the continuing text, these rare earth metals are referred to by the abbreviation "REM," which means "Rare Earth Metals." This addition of REM has resulted in a surprisingly better oxidation resistance at temperatures below the scaling temperature in air as well as water vapor, and maintained good strength and corrosion properties. Extensive investigations have shown that the range 0.10% by weight<REM≦0.30% by weight is optimal with regard to oxidation properties and annealing capability. Without being bound by any underlying theory, the improvement of the oxidation properties is considered to depend upon the content of REM dissolved in the steel, so it is important to keep down the contents of elements such as S, O and N.

There follows a listing of the preferred ranges of each element with each amount being in % by weight unless otherwise indicated:

Carbon contributes together with Ti to giving the material a sufficient creep strength. Too high an amount of carbon results in a separation of chromium carbides, which has two negative effects:

a) Separation of carbides at grain borders brings about an increased risk of intercrystalline corrosion, i.e., the material is sensitized.

b) The chromium carbides bind chromium, which deteriorates the oxidation resistance of the material.

For these reasons, a carbon content is chosen of max. 0.12%, preferably max. 0.10%, and most preferably between 0.04 and 0.08%.

Silicon contributes to a good weldability and castability. Too high silicon contents cause brittleness. Therefore, a silicon content of max. 1.0% is suitable, preferably max. 0.75%, and most preferably between 0.3 and 0.7%.

Chromium contributes a good corrosion and oxidation resistance. However, chromium is a ferrite stabilizing element and too high a content of chromium brings about an increased risk of embrittlement by the creation of a so-called σ phase. For these reasons, a chromium content of between 16 and 22% is chosen, preferably between 17 and 20%, and most preferably between 17 and 19%.

Manganese has a high affinity to sulphur and forms MnS. For production, this means that the workability is improved and for welding, an improved resistance is obtained to the formation of heat checks. Further, manganese is austenite-stabilizing, which counteracts any embrittlement. On the other hand, Mn contributes to a high alloy cost. Of these reasons, the manganese content is suitably set to max. 2.0%, preferably between 1.3 and 1.7%.

Nickel is austenite-stabilizing and is added to obtain an austenitic structure, which gives an improved strength and counteracts embrittlement. However, equally to manganese, nickel contributes to a high alloy cost. For these reasons, the nickel content is suitably set to between 8 and 14%, preferably of between 9.0 and 13.0%, and most preferably between 9.5 and 11.5%.

Molybdenum favors the segregation of embrittling σ phase. Therefore, the Mo content should not exceed 1.0%.

Titanium has a high affinity to carbon and by the formation of carbides an improved creep strength is obtained. Also, Ti in solid solution contributes to a good creep strength. The fact that Ti binds carbon also decreases the risk of separation of chromium carbide in the grain borders (so-called sensitizing). On the other hand, too high a Ti content causes brittleness. Of these reasons, the Ti content should not be lower than four times the carbon content, and not exceed 0.80%.

Alternatively, the steel may be stabilized by niobium instead of by titanium. With the same arguments as for titanium, it applies that the niobium content should not be less than 8 times the carbon content, and not exceed 1.0%.

Oxygen, nitrogen and sulphur bind REM in the form of oxides, nitrides and sulfides, so that these REM do not contribute to an improved oxidation resistance. Of these reasons, each one of the S and O contents should not exceed 0.03%, and the N content not 0.05%. Preferably, the S and the O content should not exceed 0.005% and the N content not exceed 0.02%.

REM improves, as referred to above, the oxidation resistance. Below a certain concentration of REM, this effect is not apparent. On the other hand, too high contents of REM result in the material becoming difficult to anneal. No further improvement of the oxidation resistance is achieved after the addition above a certain limit. Of these reasons, the REM content is suitably chosen to between 0.10 and 0.30%.

Melts of SS2337 with different contents of REM were produced by melting in an HF oven and casting into ingots. The chemical composition is shown in Table 1. From the ingots 10 mm thick plates were sawn across the ingot, which plates then were hot-rolled to a thickness of about 4 mm. The object of this procedure was to break down the cast structure and obtain an even grain size. At the same time an indication is obtained of the hot-workability of the alloy. The rolled plates were then annealed according to the practice for this steel type, which means a holding time of 10 minutes at 1055° C., followed by water slaking.

TABLE 1

| | Charge No. | Chemical Composition C % | Si % | Mn % | P % | S ppm | Cr % | Ni % | Mo % | Ti % | N % | Ce % | La % | Nd % | Pr % | REM* % | O ppm |
|---|---|---|---|---|---|---|---|---|---|---|---|---|---|---|---|---|---|
| Not | 654622 | 0.065 | 0.40 | 1.52 | 0.023 | 16 | 17.38 | 10.19 | 0.19 | 0.50 | 0.008 | 0.03 | 0.008 | <0.005 | <0.005 | 0.04 | 26 |
| part of | 654627 | 0.064 | 0.37 | 1.49 | 0.022 | 5 | 17.34 | 10.23 | 0.19 | 0.42 | 0.010 | 0.03 | 0.015 | 0.009 | <0.005 | 0.06 | 22 |
| the invention | 654629 | 0.078 | 0.39 | 1.49 | 0.023 | 6 | 17.32 | 10.11 | 0.19 | 0.51 | 0.008 | <0.01 | <0.005 | <0.005 | <0.005 | <0.01 | 22 |
| | 654695 | 0.063 | 0.40 | 1.44 | 0.024 | 12 | 17.42 | 10.26 | 0.26 | 0.42 | 0.009 | <0.01 | <0.005 | <0.005 | <0.005 | <0.01 | 31 |
| | 654697 | 0.062 | 0.40 | 1.52 | 0.022 | 5 | 17.53 | 10.24 | 0.25 | 0.39 | 0.010 | 0.07 | <0.005 | 0.006 | <0.005 | 0.08 | 26 |
| Part | 654620 | 0.063 | 0.45 | 1.52 | 0.024 | 10 | 17.35 | 10.15 | 0.19 | 0.48 | 0.009 | 0.13 | 0.066 | 0.03 | 0.015 | 0.25 | 12 |
| of the | 654621 | 0.064 | 0.44 | 1.51 | 0.023 | 5 | 17.36 | 10.20 | 0.19 | 0.41 | 0.009 | 0.06 | 0.027 | 0.018 | 0.015 | 0.12 | 32 |
| invention | 654626 | 0.065 | 0.42 | 1.52 | 0.023 | 14 | 17.37 | 10.20 | 0.19 | 0.46 | 0.007 | 0.06 | 0.029 | 0.018 | 0.013 | 0.12 | 15 |
| | 654699 | 0.067 | 0.42 | 1.53 | 0.025 | 10 | 17.34 | 10.17 | 0.26 | 0.45 | 0.010 | <0.01 | 0.11 | <0.005 | <0.005 | 0.11 | 31 |
| | 654701 | 0.067 | 0.43 | 1.52 | 0.023 | <5 | 17.35 | 10.16 | 0.26 | 0.41 | 0.011 | <0.01 | <0.005 | <0.05 | 0.14 | 0.15 | 30 |
| | 654703 | 0.065 | 0.43 | 1.50 | 0.023 | 12 | 17.34 | 10.14 | 0.26 | 0.40 | 0.012 | <0.01 | <0.005 | 0.12 | <0.005 | 0.12 | 51 |
| | 654705 | 0.64 | 0.42 | 1.51 | 0.024 | 5 | 17.31 | 10.17 | 0.25 | 0.41 | 0.010 | 0.11 | <0.005 | <0.005 | <0.005 | 0.11 | 29 |

Figure 2:
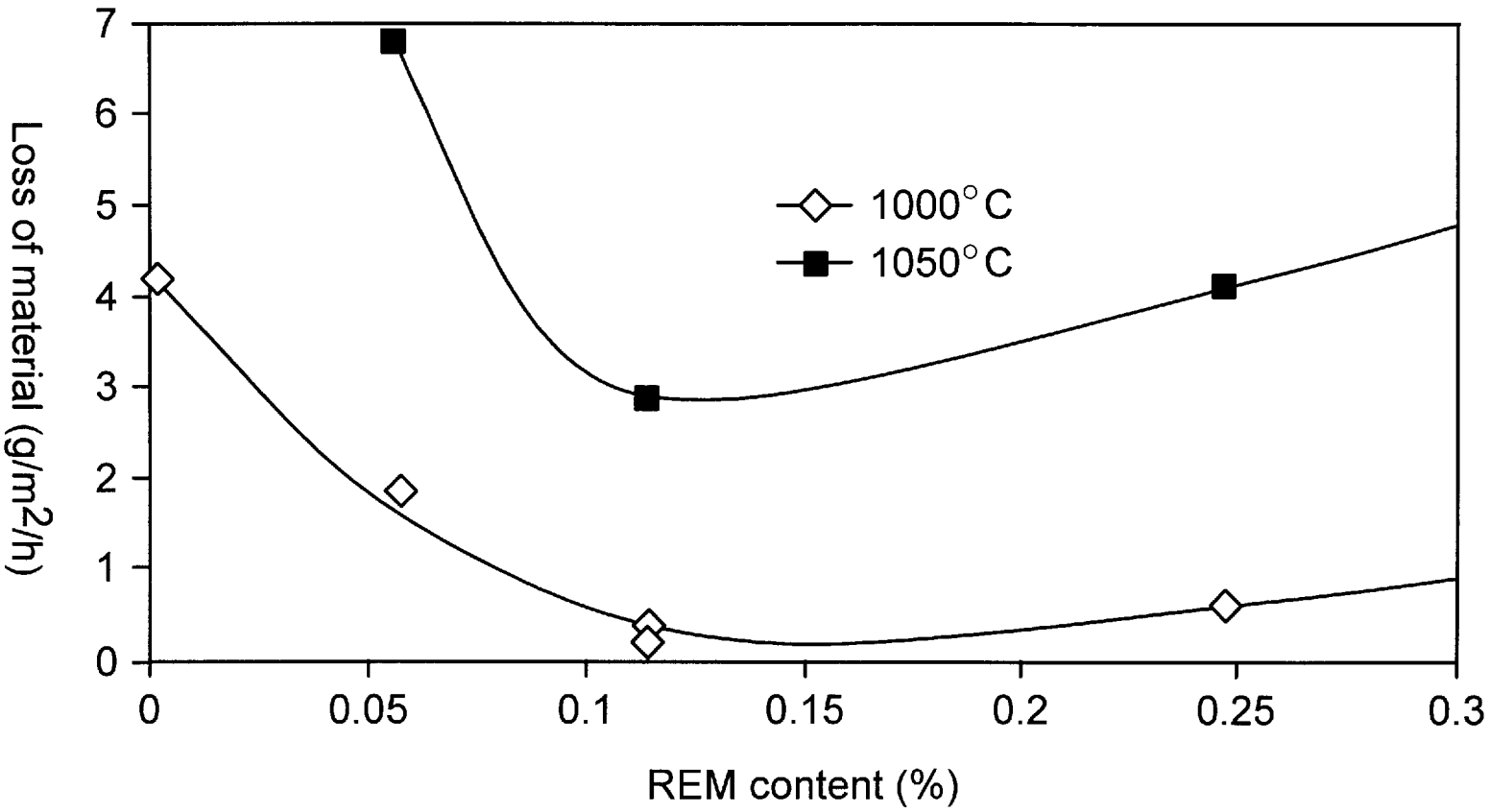
FIG. 2 is a graph of oxidation speed as expressed as loss of material vs. REM (rare earth metal) content at 1000° C. and 1050° C.

For the oxidation assay, rectangular so-called oxidation coupons were cut out in a size of 15×30 mm, whose surface was ground with a 200 grain grinding paper. The assays were then oxidized during 10 days in air atmosphere at 1000°, 1050° and 1100° C., respectively. Since the oxidation causes both a scaling and an adhering oxide, it is difficult by simply weighing before and after the oxidation assay to determine how big the weight loss is due to the oxidation. Instead, the assays were weighed after that the oxide has been blasted away. The difference in weight before the assay and after the oxide removal can then, having regard to the assay time and the assay dimension, be used as a measure for the scaling speed. The result may be seen in FIG. 1, from which the scaling temperature for the different charges may be read. In this Figure, the set point value 1.5 $g/m^2 \cdot h$ is shown. It may be clearly seen in FIG. 1 that the scaling temperature is increased by the addition of REM, cf. the three alloys 654620, 654621 and 654626 according to the invention compared with the two according to prior art 654627 and 654629. This effect is also illustrated in FIG. 2, where the oxidation speed has been plotted as a function of the REM contents. Thereby, it may be seen that at a REM content larger than about 0.20%, a clear decrease of the oxide formation takes place. At REM contents larger than about 0.25%, the oxidation speed increases again. This is dependent on the formation of cracks in the material, which is a consequence of the fact that too high a REM content has a negative effect on the hot-forming properties. Thus, optimal content of REM is about 0.10–0.30%, preferably above 0.10 and up to 0.20%.

Figure 3:
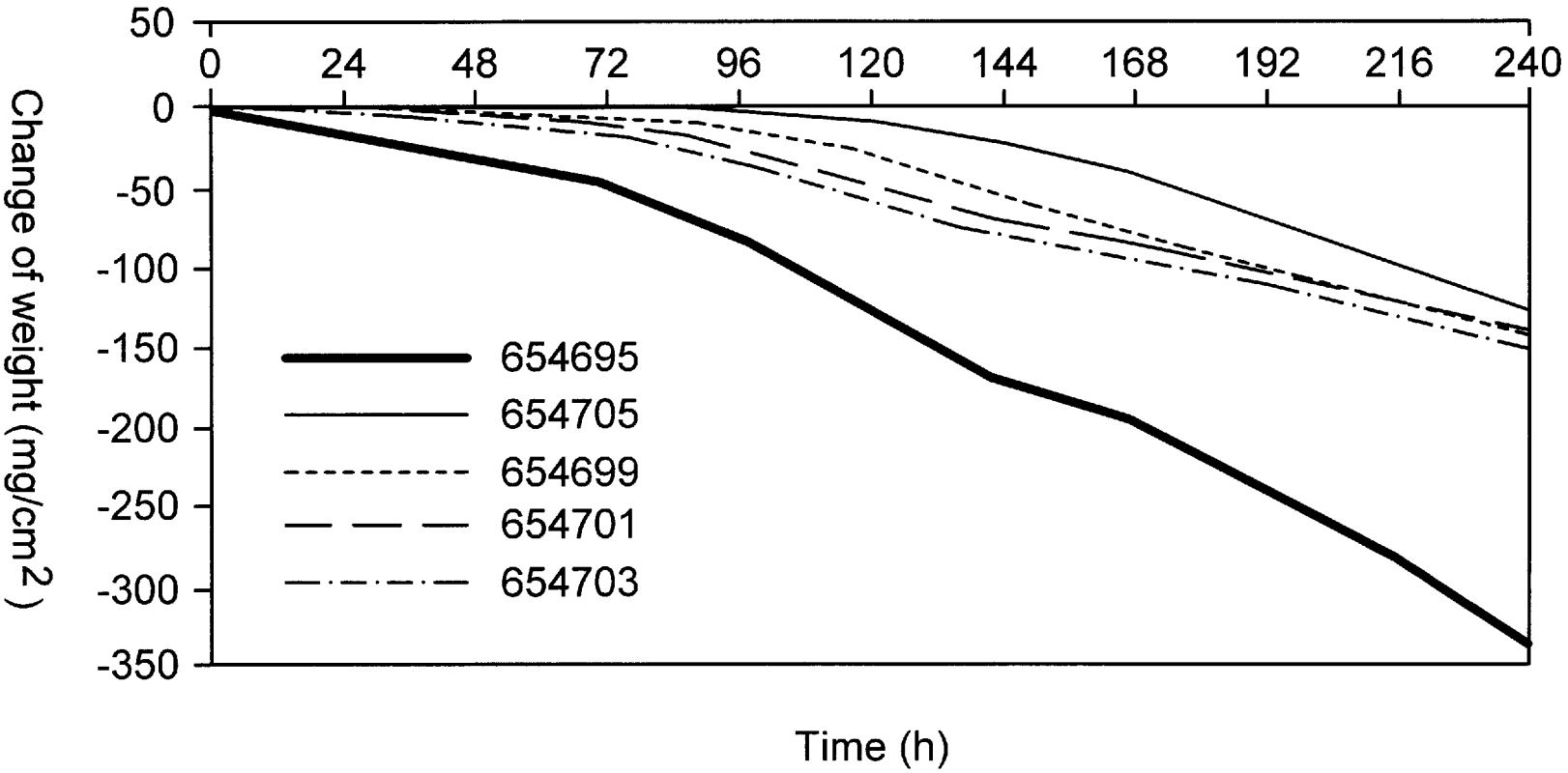
FIG. 3 is a graph of change of weight vs. time for various compositions.

An investigation was performed in order to find out the influence on the oxidation properties for each one of the elements in the REM array. Charges were produced according to the procedure described above and were oxidation-tested in air at 1050° C., and the change in weight was measured once per day. The results in FIG. 3 show that all elements comprised in the REM array have a positive effect on the oxidation resistance of the material, i.e., the scaling speed (weight loss per time unit) becomes lower. Thus, each one of the charges tested according to FIG. 3, 654705, 654699, 654701 and 654703, has a high content of one of the four elements Ce, La, Pr and Nd, respectively, while 654695 has a REM content below 0.01%. The difference in changes of weight may be clearly seen in FIG. 3.

A hitherto unknown, surprising effect is that the REM content has a positive effect also at temperatures below the scaling temperature and in water vapor. This may be seen from the cyclic oxidation assay performed in air at 700° C., and from the isothermic oxidation assay in vapor at 600° C. and 700° C. The same type of oxidation coupons as the ones described above are used for these assays. Since the oxidation speed is markedly lower at these temperatures, the assay has to be made during a considerably longer time, so that measurable differences may be demonstrated. The oxidation courses at the assays in question were measured by weighing at regular intervals. The results are shown in FIGS. 4, 5 and 6.

Figure 4:
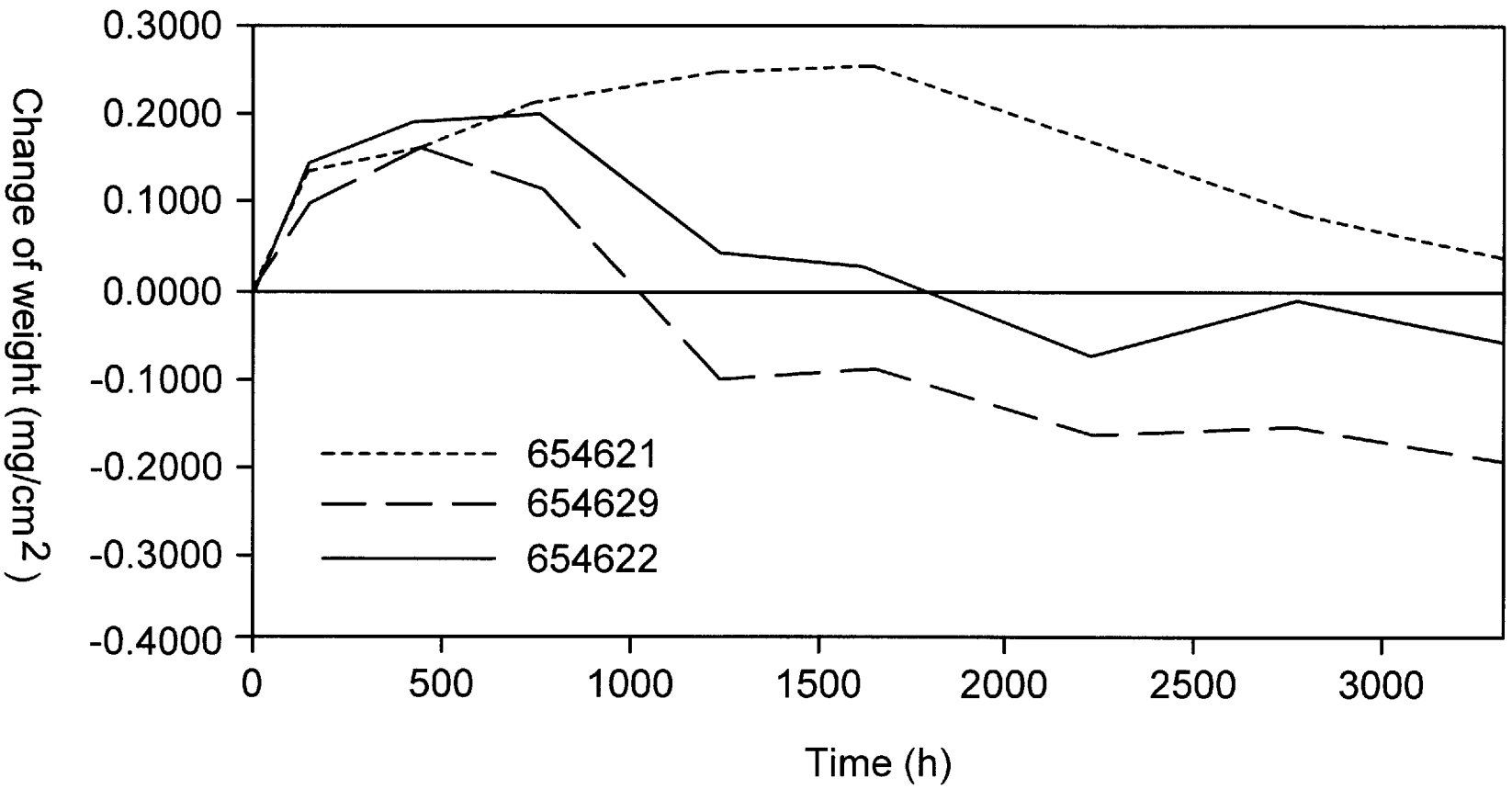
FIG. 4 is a graph of change of weight vs. time for various compositions at specified cycles in a cyclic oxidation test.

The cyclic oxidation assay in air at 700° C. according to FIG. 4 results in a lower oxidation speed for the REM-alloyed materials.

Figure 5:
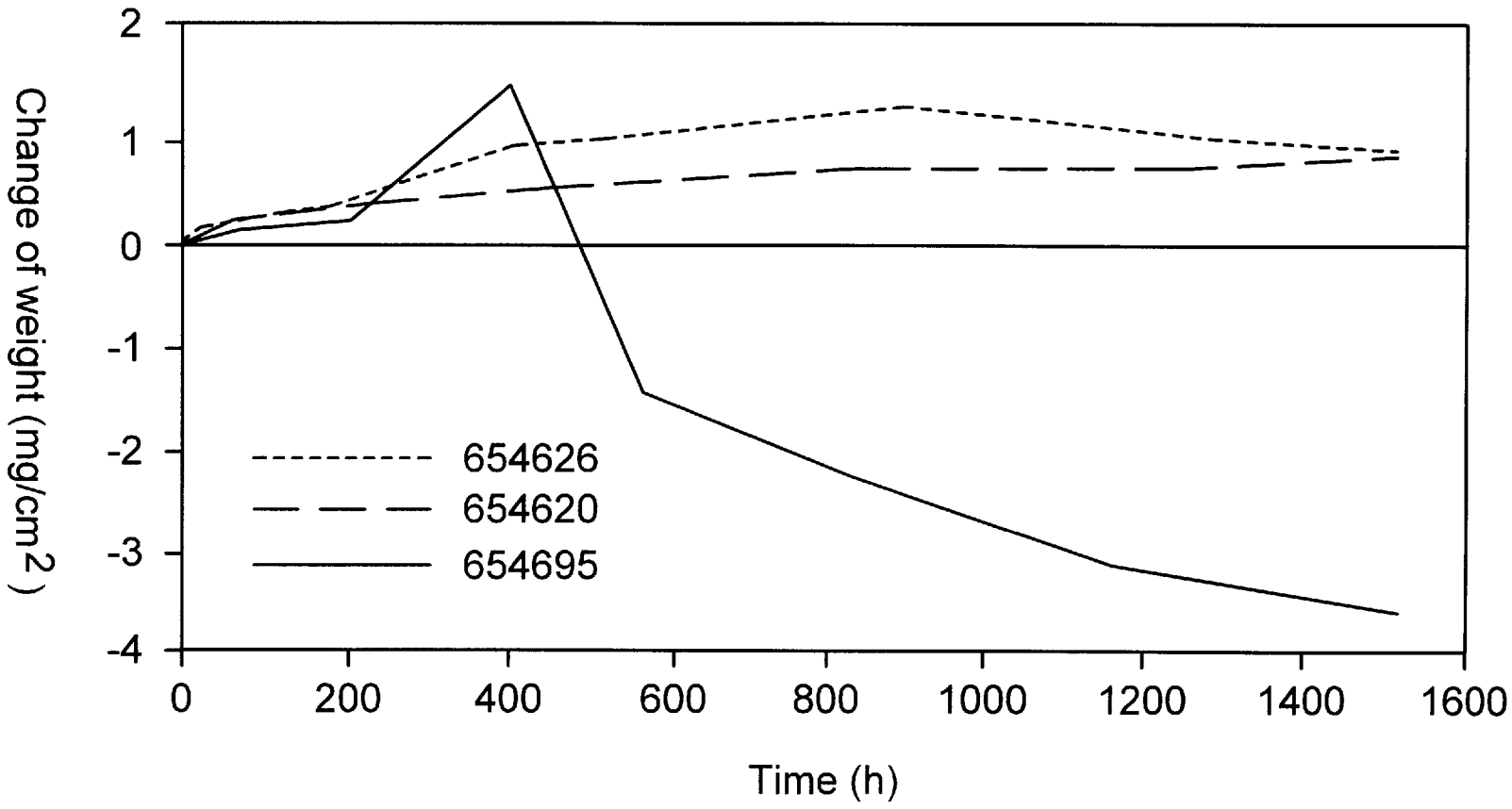
FIG. 5 is a graph of change of weight vs. time for various compositions at specified cycles in a cyclic oxidation test.

In FIG. 5 may be seen that for SS2337 without any REM (charge 654695), the weight diminishes after 400 h in vapor at 700° C., which means that the material peels, i.e., oxide flakes, fall off. For the charges that have been alloyed with rare earth metals, only a weak weight increase takes place, which indicates that the material forms an oxide with good adhesion. As mentioned above, this is a desirable property for alloys that are used in superheater tubes.

Figure 6:
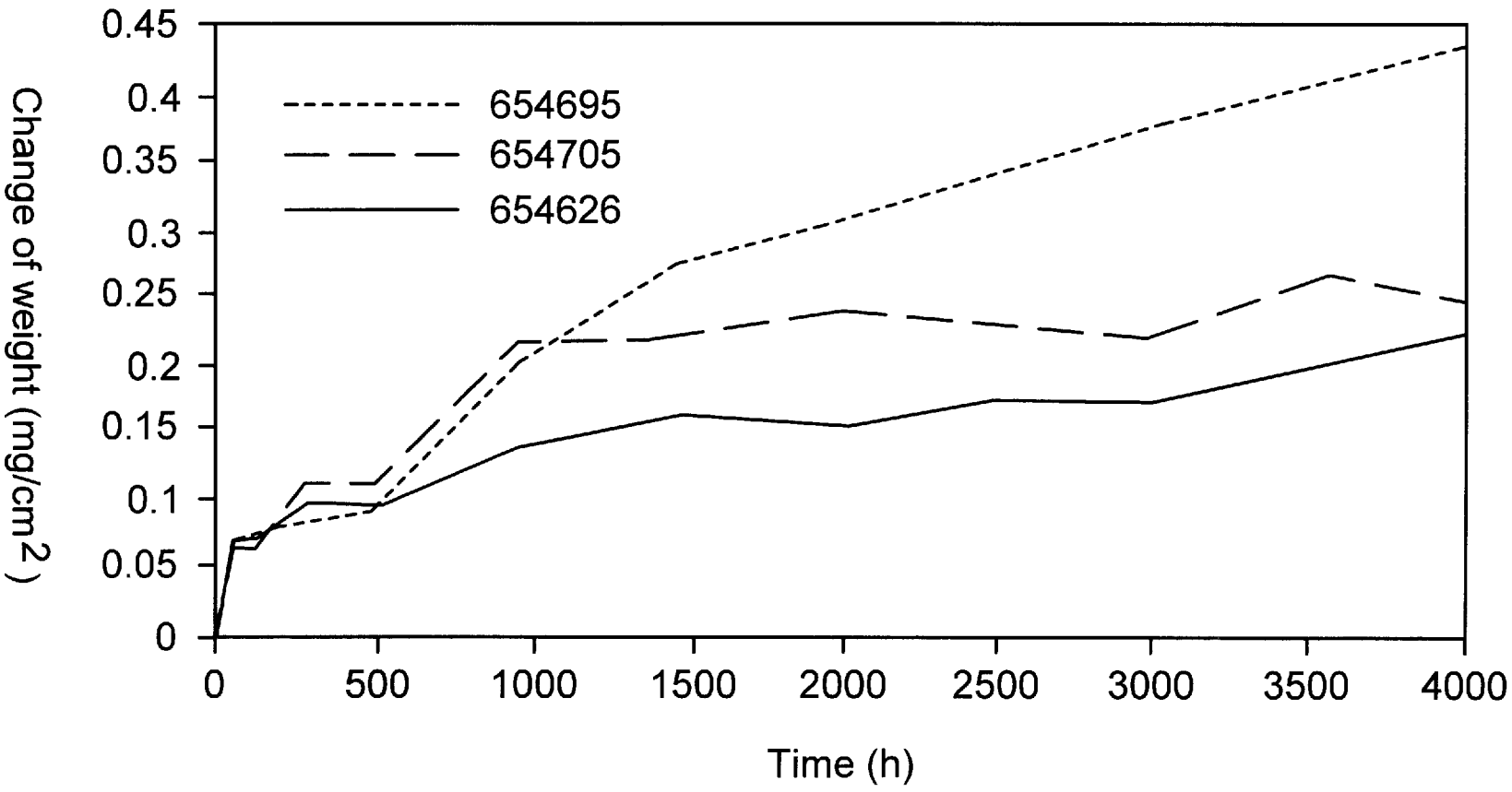
FIG. 6 is a graph of change of weight vs. time for various compositions at specified cycles in a cyclic oxidation test.

FIG. 6 shows that in vapor of 600° C., the oxide grows slower on materials with an addition of REM, which as mentioned above, is desirable for a material with a good oxidation resistance.

The improvement of the oxidation properties comes from the content of REM present in solution in the steel. Elements such as sulphur, oxygen and nitrogen react easily with REM already in the steel melt and forms stable sulfides, oxides and nitrides. REM bound in these compounds are therefore not credited to the oxidation properties, wherefore the S, O and N contents should be kept low.

A performed creep assay demonstrates no impaired creep strength for the REM-alloyed material.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. An austenitic stainless steel consisting essentially of, in % by weight:

C: <0.12,

Si: <1.0,

Cr: 16–22,

Mn: 1.3–1.7

Ni: 8–14,

Mo: <1.0, either Ti: >4% by weight of C and <0.8 or Nb: 8% by weight of C and <1.0,

S: <0.03,

O: <0.03,

N: <0.05,

REM: ≦0.30 and >0.10, and the remainder Fe and normally occurring impurities, REM being one or more of the elements Ce, La, Pr and Nd.

2. The austenitic stainless steel of claim 1, wherein the carbon content is between 0.04 and 0.08%.

3. The austenitic stainless steel of claim 1, wherein the silicon content is between 0.3 and 0.7%.

4. The austenitic stainless steel of claim 1, wherein the chromium content is between 17 and 20%.

5. The austenitic stainless steel of claim 1, wherein the nickel content is between 9.0 and 13.0%.

6. The austenitic stainless steel of claim 1, wherein the REM content is >0.10% and ≦0.20%.

7. A superheater component made of the austenitic stainless steel of claim 1.

8. A heat exchanger component made of the austenitic stainless steel of claim 1.

9. A convection part of an ethene oven made of the austenitic stainless steel of claim 1.

* * * * *